US007726363B2

(12) United States Patent
Benjey et al.

(10) Patent No.: US 7,726,363 B2
(45) Date of Patent: Jun. 1, 2010

(54) FILLER TUBE ASSEMBLY FOR A FUEL VAPOR RECIRCULATION SYSTEM

(75) Inventors: Robert P. Benjey, Dexter, MI (US); Daniel L. Pifer, Chelsea, MI (US); Russell C. Jahnke, Ann Arbor, MI (US)

(73) Assignee: Eaton Corporation, Cleveland, OH (US)

( * ) Notice: Subject to any disclaimer, the term of this patent is extended or adjusted under 35 U.S.C. 154(b) by 1137 days.

(21) Appl. No.: 11/337,137

(22) Filed: Jan. 20, 2006

(65) Prior Publication Data

US 2007/0169845 A1 Jul. 26, 2007

(51) Int. Cl.
*B65B 1/04* (2006.01)

(52) U.S. Cl. ..... 141/302; 141/198; 141/59

(58) Field of Classification Search ..... 141/192, 141/198, 206, 350, 5, 301, 302, 348, 386, 141/389, 59, 286; 220/86.2, 746; 251/1.1; 29/888.4; 137/467; 96/156

See application file for complete search history.

(56) References Cited

U.S. PATENT DOCUMENTS

| | | | | |
|---|---|---|---|---|
| 4,044,913 | A | 8/1977 | Brunnert | |
| 4,630,749 | A * | 12/1986 | Armstrong et al. | 220/86.2 |
| 4,816,045 | A | 3/1989 | Szlaga et al. | |
| 4,966,299 | A * | 10/1990 | Teets et al. | 220/746 |
| 5,735,322 | A | 4/1998 | Palvolgyi | |
| RE37,776 | E | 7/2002 | Foltz | |
| 6,415,827 | B1 | 7/2002 | Harris | |
| 6,945,290 | B1 | 9/2005 | Benjey | |
| 2005/0126657 | A1 * | 6/2005 | Allman et al. | 141/286 |

* cited by examiner

*Primary Examiner*—Timothy L Maust
*Assistant Examiner*—Jason K Niesz
(74) *Attorney, Agent, or Firm*—Anna M. Shih

(57) ABSTRACT

A filler tube assembly for use in a system having vapor recirculation includes a check valve having a flapper that is responsive to the viscosity of fluid around the flapper and/or a differential pressure across the flapper. The assembly also includes a nozzle chamber formed in the filler neck that has a constant diameter to ensure consistent vacuum generation regardless of fuel nozzle length.

11 Claims, 3 Drawing Sheets

FILLER TUBE ASSEMBLY FOR A FUEL VAPOR RECIRCULATION SYSTEM

TECHNICAL FIELD

The present invention relates to filler tube assemblies for fuel tank installations having a fuel vapor recirculation tube ported to the upper end of the filler tube in an enlarged nozzle receiving end.

BACKGROUND OF THE INVENTION

Fuel vapor recirculation tubes are used in motor vehicle fuel tank filler tubes to recirculate fuel vapor during refueling from a nozzle inserted in the filler tube with a mechanical seal provided about the nozzle. The recirculated vapor provides a make-up flow below the nozzle seal to prevent the flow discharging from the nozzle from creating a vacuum in the filler tube and prematurely activating the automatic nozzle shutoff.

Known fuel tank filler tube installations having a vapor recirculation tube attached to a port in the filler tube below the nozzle seal. This configuration sometimes allows liquid fuel to enter the vapor recirculation tube and flow into the vapor vent system when liquid fuel rises in the filler tube as the tank is filled. Liquid fuel in the vapor vent system can block the vapor vent lines, trap fuel in low regions of the system or even cause degradation of the vapor storage medium in the vapor storage canister if fuel enters the canister.

Known filler tubes also have a tapered nozzle chamber in the vicinity of the recirculation tube. The nozzle chamber surrounds the end of the nozzle when it is inserted into the filler tube and helps generate a vacuum condition in when mechanical seals are used. The diameter of the nozzle chamber around the nozzle should allow enough liquid to flow between the inner diameter of the nozzle chamber and the outer diameter of the nozzle to avoid excess fuel tank pressure when the nozzle fails to shut off. However, the length of the nozzle can vary, causing the ends of different nozzles to reach different areas in the nozzle chamber. Because the vacuum created in the filler tube depends on how much space is between the tip of the nozzle and the surrounding filler tube, filler tubes with a tapered nozzle chamber will generate inconsistent vacuum conditions because different nozzle lengths will end at different diameter portions of the nozzle chamber.

There is a desire for a way to protect a fuel vapor recirculation system from liquid fuel flowing into the vapor lines and to do so in a manner that is simple and low in cost and does not require substantial reworking or retooling of the fuel tank filler tube. There is also a desire for a reliable way to generate a consistent vacuum in the nozzle chamber regardless of the nozzle length.

BRIEF SUMMARY OF THE INVENTION

The present invention prevents liquid fuel from entering into the vapor recirculation line, which is tapped into the filler tube below the nozzle seal, when fuel rises in the filler tube when the tank is full. The invention includes a check valve having a flapper attached to the insert that is placed in the filler tube. The flapper is sensitive to fluid viscosity and distinguishes between liquid fuel and fuel vapor due to the inherently different viscosities of liquid and vapor. During use, the check valve response to the changes in viscosity of fuel surrounding the flapper as well as the differential pressure on either side of the flapper to open and close the vapor port.

The flapper of the present invention therefore closes when liquid fuel enters the upper end of the filler tube and opens in response to vapor pressure to allow proper vapor recirculation. By responding to both viscosity and differential pressure around the check valve, the check valve can distinguish between fuel vapor and liquid fuel in a simple yet reliable manner.

The invention is also directed to a filler tube assembly having a nozzle chamber with a constant diameter. The constant diameter nozzle chamber ensures that the space between the nozzle and the chamber remains consistent regardless of the nozzle length, making the vacuum condition within the chamber consistent as well. A failed nozzle relief valve may also be included to provide an alternative flow path for fuel and vapor in the case of nozzle shutoff failure.

DETAILED DESCRIPTION OF THE INVENTION

Figure 1:
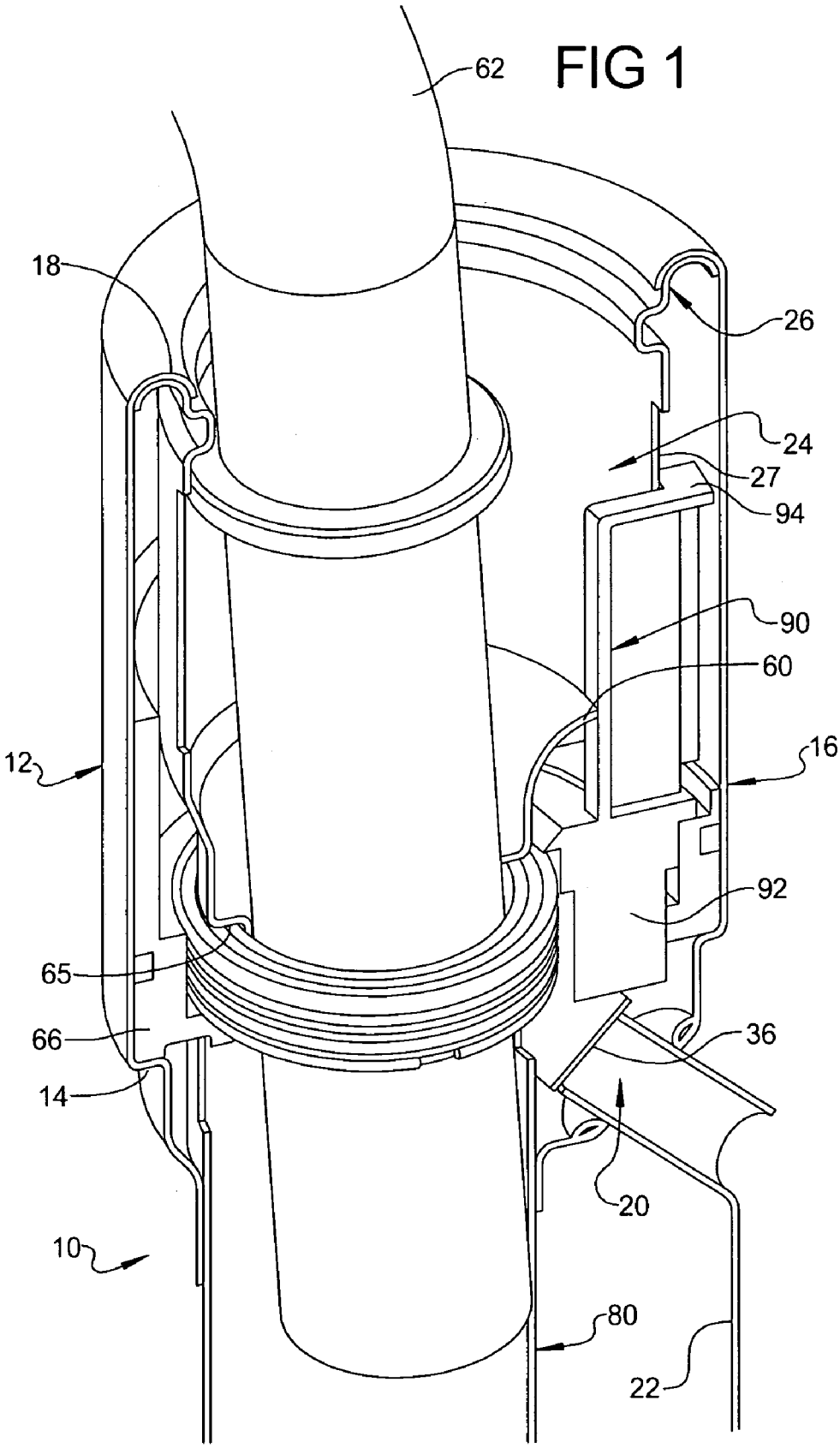
FIG. 1 is a broken-away perspective view of the filler tube assembly for a fuel tank employing one embodiment of the present invention showing a refueling nozzle inserted therein.
Figure 2:
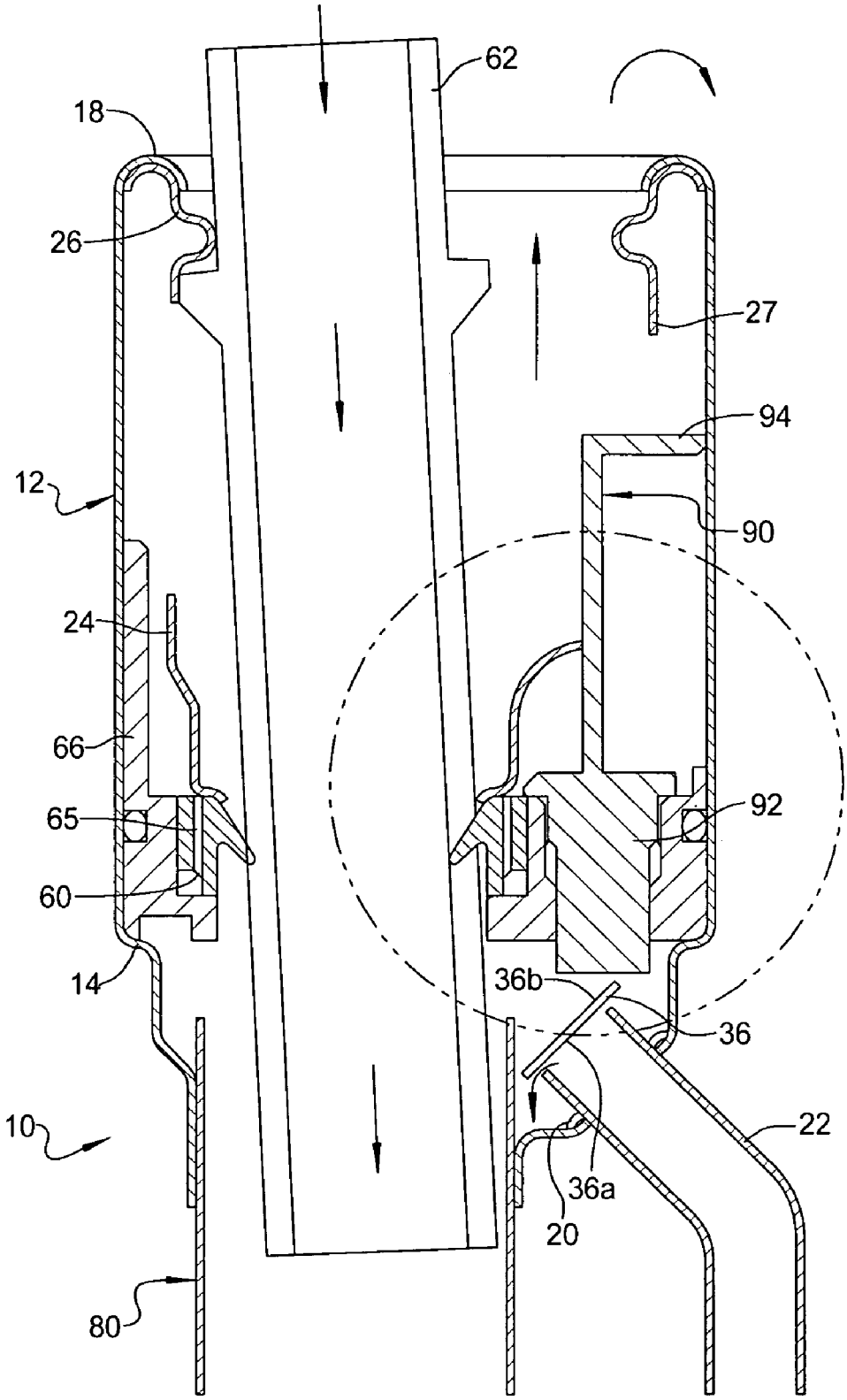
FIG. 2 is a cross-section of the assembly showing a check valve in the open position and a failed nozzle relief valve in the closed position.
Figure 3:
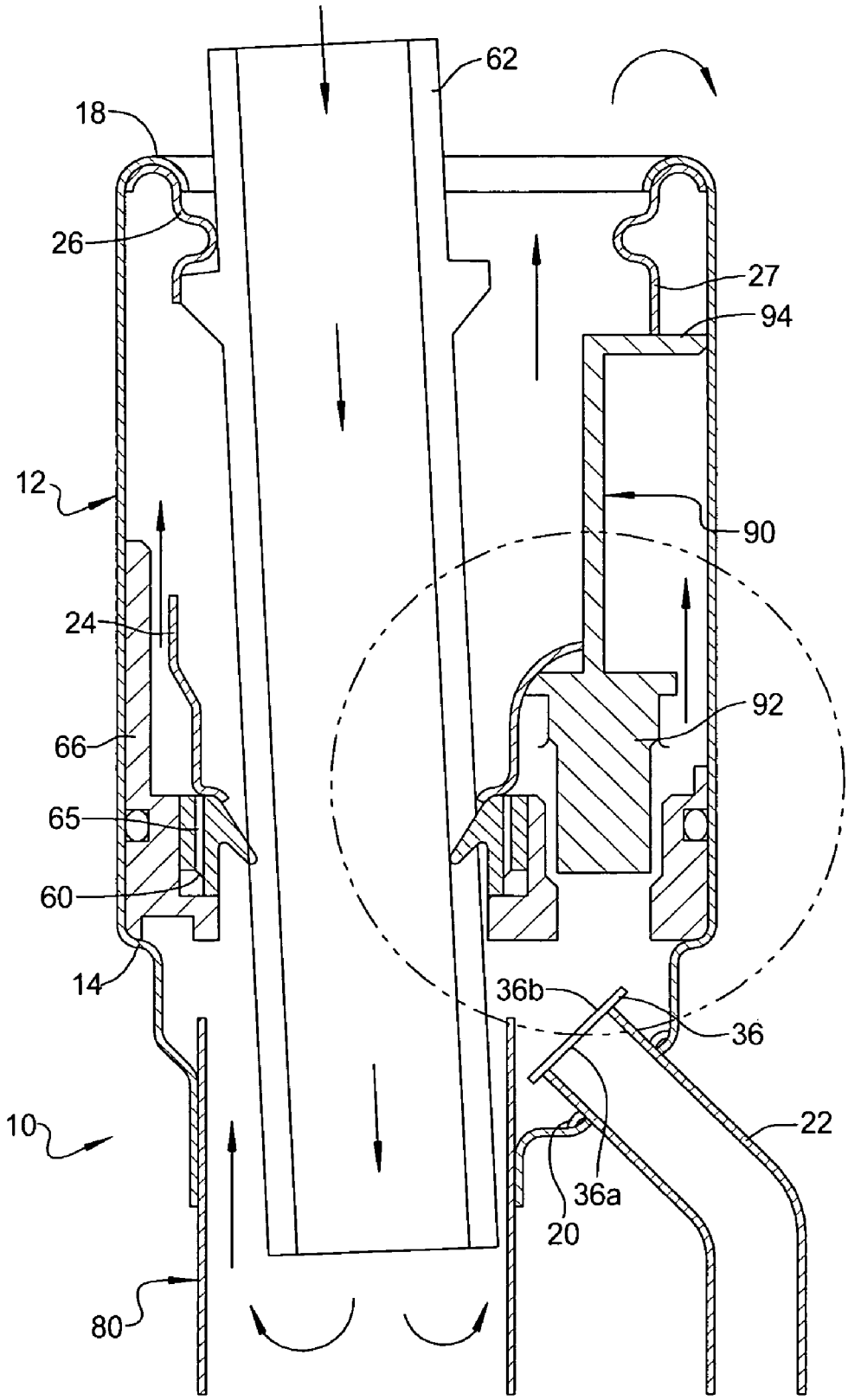
FIG. 3 is a cross-section of the assembly showing the check valve in the closed position and the failed nozzle relief valve in the open position.

Referring to FIGS. 1 through 3, the inventive assembly includes a fuel tank filler tube 10 having an upper end 12. An annular step or shoulder 14 is formed on the tube 12. The step 14 transitions the tube 12 to an enlarged diameter portion 16 having an inwardly curling lip 18 formed at the upper end thereof. The tube 12 has a recirculation port or aperture 20 formed therein which is adapted for accommodating a recirculation tube 22 known in the fuel tank vapor system art.

A vapor check valve assembly 24 is disposed in the filler tube 10 and includes an annular flange 26 formed about an upper circumference of a cylinder 27. Upon installation of the assembly 24 in tube 16, the annular flange 26 engages the lip 18 of the tube portion 16 to maintain the insert against the shoulder 14. The check valve assembly 24 includes a flexible flapper 36 that can flex and move to open and close the recirculation port 20. In one embodiment, the flapper 36 is made of a material that is stiff enough to hold its shape yet flexible enough to bend and flex in response to forces applied to it. One possible material for the flapper 36 is a polymer film, such as TEFLON® or MYLAR® film, or other material having similar properties.

The check valve assembly 24 is shown in the open position in FIG. 2 with the flapper 36 next to, but not closing, the recirculation port 20. In one embodiment, the natural stiffness of the flapper 36 material makes it naturally stand slightly away from the recirculation portion 20 when it is installed in the assembly 24. The flapper 36 is a viscosity-sensitive flapper 36 that distinguishes between liquid fuel and fuel vapor due to the inherently different viscosities of liquid and vapor. During use, the flapper 36 response to the changes in viscosity of fuel surrounding the flapper 36 as well as the differential pressure on either side of the flapper to open and close the vapor port. For example, a differential pressure occurs when a fluid, such as liquid fuel or fuel vapor, flows along one side **36*a* of the flapper 36*a* at a first flow rate and flows along the other side 36*b* of the flapper at a slower flow rate; this differential pressure will tend to push the flapper 36 toward the port 20** to close it.

Referring to FIG. 2, the valve 24 is shown in the open position with the flapper 36 leaving the port 20 open so that fuel vapor can circulate through the port 20. The flapper 36 would be in this open state during, for example, normal refueling. Fuel vapor, which is a low viscosity fluid, flows at a moderate flow rate against one side 36*a* of the flapper 36. The low viscosity of the fuel vapor also allows it to flow easily around the flapper 36 to the other side 36*b*. This vapor flow, combined with vapor flowing through the recirculation tube port 20, causes the pressure on both sides 36*a*, 36*b* to be roughly equal (i.e., a small differential pressure). As a result, the flapper 36 will substantially remain unbent, thereby leaving the port 20 open. The movement of the flapper 36 away from port 20 may be attenuated or arrested by the spring tab 30 as shown by the position of the flapper 36 in solid outline in FIG. 2.

FIG. 3 shows the flapper 36 in a closed position. This would occur when, for example, liquid fuel starts entering the nozzle chamber 80 in the event of a nozzle shut-off failure. The flapper 36 responds to the higher differential pressure (i.e., the difference in pressure on either side of the flapper), which is created by the rushing liquid fuel alongside the first side 36*a* of the flapper 36, by moving toward the port 20. Further, if the fluid on the first side 36*a* of the flapper 36 is liquid fuel and the fluid on the other side 36*b* of the flapper 36 is fuel vapor, the higher viscosity of the liquid fuel against the first side 36*a* of the flapper 36 will also tend to push the flapper 36 toward the port 20 to close it. Thus, the flapper 36 is responsive to the viscosity of the fluid (both liquid and vapor) around the flapper 36, the differential pressure across the flapper 36, or both. As a result, the normally-open flapper 36 closes when liquid fuel enters the upper end of the filler tube 12 to prevent liquid fuel from entering the recirculation port 20 if a nozzle shutoff failure occurs.

As shown in the figures, the assembly 12 also includes an annular lip seal 60 that is sized and configured to seal about the periphery of a refueling nozzle 62 when the nozzle is inserted therein, thereby forming a mechanical seal. The seal 60 is retained between a stepped portion 65 of the cylinder 27 and a sealing insert 66, which is in turn frictionally held in place within the enlarged diameter portion 16 of the tube 12.

The tube 12 itself has a nozzle chamber 80 that surrounds the end portion of the refueling nozzle 62 when is it inserted into the tube 12. The nozzle chamber surrounds the end of the nozzle helps generate a vacuum condition in when mechanical seals are used. During refueling, liquid flows along the path shown by the arrows in the figure and also flows between the outside diameter of the nozzle 62 and the inner wall of the nozzle chamber 80. There should be enough space between the two to avoid excess fuel tank pressure when the nozzle 62 fails to shut off automatically. A jet-pump action created by fuel flow helps generate a vacuum condition in the tube 12 when a mechanical seal, such as the lip seal 60, is used to prevent overfilling of the fuel tank.

The nozzle chamber 80 in the invention has a constant diameter rather than a tapered, semi-conical shape. Because the vacuum created in the filler tube 62 depends on how much space is between the tip of the nozzle and the surrounding nozzle chamber 80, the constant diameter of the nozzle chamber 80 ensures that the distance between the nozzle 62 and the nozzle chamber 80 is consistent regardless of the length of the nozzle 62. As a result, the vacuum generated within the nozzle chamber is more consistent, creating a more reliable and predictable response to nozzle shut-off failures.

As noted above, the flapper 24 prevents liquid fuel from entering the port 20 in the case of a failed nozzle shutoff and resulting overfill. As shown in the figures, the system 10 also includes a failed nozzle relief (FNR) valve 90 that provides an alternative flow path in the case of a failed nozzle shutoff. The arrows in FIG. 3 show one example of an alternative flow path that is created when the FNR valve 90 opens during a nozzle shutoff failure. One type of FNR valve that could be used is described in commonly assigned U.S. Application No. 11/337,117 now U.S. Pat. No. 7,484,525. In one embodiment, the FNR valve 90 is a poppet valve having a seal 92 and a reset lever 94 designed to contact a fuel cap (not shown). The FNR valve 90 may also be held in place by the sealing insert 66 as shown in the figures.

As shown in FIG. 2, during normal refueling, the FNR valve 90 is in a closed position to limit fuel vapor and air flow into the fuel tank (not shown). If a failed nozzle condition occurs, however, the increased fluid pressure trips a spring 96 that pushes the FNR valve 90 upward to an open position as shown in FIG. 3. This creates an alternative liquid and vapor flow path, as shown by the arrows in FIG. 3, so that fluid flows toward the upper end 12 of the filler tube to indicate that the nozzle needs to be manually shut off.

When the FNR valve 90 is in the open position, the reset lever 94 extends far enough upward to contact a fuel cap (not shown) when it is replaced. When the operator replaces the fuel cap, the fuel cap presses downward on the reset lever 94, thereby pushing the entire FNR valve 90 downward back to the closed position to reset the valve 90. As a result, the FNR valve 90 eliminates the need for a separate resetting mechanism.

By responding to both viscosity and differential pressure around the check valve, the check valve can distinguish between fuel vapor and liquid fuel in a simple yet reliable manner. The present invention thus provides a one-way check valve for closing the vapor vent recirculation port in a fuel tank filler tube and which is formed as an insert subassembly which may be inserted in an existing filler tube. Further, the tube includes a nozzle chamber having a constant diameter, ensuring that the vacuum condition generated in the chamber is independent of the fuel nozzle length and keeping the nozzle shut-off response consistent when there is a mechanical seal in the system. The FNR valve may also be included and is designed to reset easily when a filler cap is replaced over the filler tube.

Although the invention has hereinabove been described with respect to the illustrated embodiments, it will be understood that the invention is capable of modification and variation and is limited only by the following claims.

What is claimed is:

1. A fuel tank filler tube assembly, comprising:

a filler tube having an enlarged end for receiving a refueling nozzle, wherein a vapor recirculation port is formed in the wall of the enlarged end;

a flapper that opens and closes the port in response to at least one of a differential pressure across the flapper and a viscosity of the fuel in the tubular member such that the flapper substantially prevents passage of liquid fuel from the filler tube into the port and permits fuel vapor flow into the port when in the open position;

a nozzle chamber formed below the enlarged diameter end, wherein the nozzle chamber has a substantially constant diameter; and a failed nozzle relief (FNR) valve having a reset lever adapted to contact a fuel cap when said fuel cap is placed on the fuel tank filler tube.

2. The assembly of claim 1, wherein the flapper is made of a flexible material.

3. The assembly of claim 2, wherein the flexible material is a polymer film.

4. The assembly defined in claim 1, wherein the FNR valve is in a normally closed position, and wherein the FNR valve opens to generate an alternative fluid flow path in response to a failed nozzle condition.

5. The assembly defined in claim 1, wherein the FNR valve is closed when the flapper is open and wherein the FNR valve is open when the flapper is closed.

6. A fuel tank filler tube assembly, comprising:

a filler tube having an enlarged end for receiving a refueling nozzle, wherein a vapor recirculation port is formed in the wall of the enlarged end;

a flexible flapper that opens and closes the port in response to at least one of a differential pressure across the flapper and a viscosity of the fuel in the tubular member such that the flapper substantially prevents passage of liquid fuel from the filler tube into the port and permits fuel vapor flow into the port when in the open position, and wherein the flapper is in the closed position during a failed nozzle condition;

a nozzle chamber formed below the enlarged end, wherein the nozzle chamber has a substantially constant diameter; and a failed nozzle relief (FNR) valve having a reset lever adapted to contact a fuel cap when said fuel cap is placed on the fuel tank filler tube, wherein the FNR valve moves during the failed nozzle condition to generate an alternative fluid flow path.

7. The assembly of claim 6, wherein the flexible material is a polymer film.

8. The assembly defined in claim 6, wherein the FNR valve is in a normally closed position, and wherein the FNR valve opens to generate the alternative fluid flow path in response to the failed nozzle condition.

9. A method of making a fuel tank filler tube for use in a system with fuel vapor recirculation comprising:

forming a tubular member with an enlarged end for receiving a refueling nozzle and forming a vapor recirculation port in the enlarged end for vapor recirculation;

forming a nozzle chamber having a substantially constant diameter below the enlarged diameter end;

disposing a flexible flapper for movement between an open and closed position with respect to the vapor recirculation port; and disposing a failed nozzle relief (FNR) valve in the filler tube, wherein the FNR valve is positioned so that a reset lever on the FNR valve is adapted to contact a fuel cap when said fuel cap is placed on the fuel tank filler tube.

10. The method defined in claim 7, wherein said step of disposing a flexible flapper includes attaching the flapper to an insert and disposing the insert in said enlarged end.

11. The method defined in claim 7, wherein said step of disposing a flapper includes providing an insert and attaching the flapper to the insert and disposing the insert in the enlarged end of said tubular member.

* * * * *